US005374062A

United States Patent [19]

Kochevar

[11] Patent Number: 5,374,062

[45] Date of Patent: Dec. 20, 1994

[54] SWING WEIGHT WITH LOCKING FEATURE AND GOLF CLUB AND METHOD UTILIZING THE SAME

[76] Inventor: Rudolph J. Kochevar, P.O. Box 661088, Arcadia, Calif. 91066-1088

[21] Appl. No.: 149,609

[22] Filed: Nov. 9, 1993

[51] Int. Cl.[5] ..... A63B 53/02

[52] U.S. Cl. ..... 273/169; 273/167 F; 273/80.8

[58] Field of Search ..... 273/80 R, 80 A, 80 B, 273/80 C, 80 D, 80.1, 80.2, 80.3, 80.4, 80.5, 80.6, 80.7, 80.8, 80.9, 77 R, 167 K, 169, 167 F, 193 R, 194 R, 75, 194 B, 171, 173, 170, 81 R

[56] References Cited

U.S. PATENT DOCUMENTS

| | | | |
|---|---|---|---|
| 1,981,085 | 11/1934 | Aldrich | 273/80.4 |
| 3,410,558 | 11/1968 | Reuter | 273/80.2 |
| 3,429,576 | 2/1969 | Ikeda | 273/80.1 |
| 3,625,513 | 12/1971 | Ballmer | 273/80.8 |
| 3,645,008 | 2/1972 | Delsack | 273/75 |
| 4,063,737 | 12/1977 | Tom | 273/80.5 |
| 4,220,336 | 9/1980 | Kochevar . | |
| 4,452,456 | 6/1984 | Kochevar | 273/80.8 |
| 4,496,153 | 1/1985 | Kochevar | 273/80.8 |
| 4,854,583 | 8/1989 | Kobayashi | 273/80.2 |
| 4,936,586 | 6/1990 | Raemdonck | 273/81 A |
| 4,988,102 | 1/1991 | Reisner | 273/81 A |
| 5,181,720 | 1/1993 | Stites | 273/80.8 |
| 5,205,552 | 4/1993 | Green | 273/80.2 |
| 5,205,553 | 4/1993 | Okumoto | 273/80.2 |
| 5,261,669 | 11/1993 | Kochevar | 273/80.8 |

FOREIGN PATENT DOCUMENTS

| | | | |
|---|---|---|---|
| 0315423 | 5/1989 | European Pat. Off. | 273/73 J |

*Primary Examiner*—Sebastiano Passaniti
*Attorney, Agent, or Firm*—Gordon L. Peterson

[57] ABSTRACT

A swing weight for a golf club wherein the swing weight includes a main body sized and adapted to be received in a tubular shaft of the golf club, a flange adjacent one end of the main body and having larger cross-sectional dimensions than the main body, and a locking region on the main body adjacent to flange. The locking region has a cross-sectional dimension which is less than a cross-sectional dimension of the flange and which is greater than a cross sectional dimension of other regions of the main body.

11 Claims, 1 Drawing Sheet

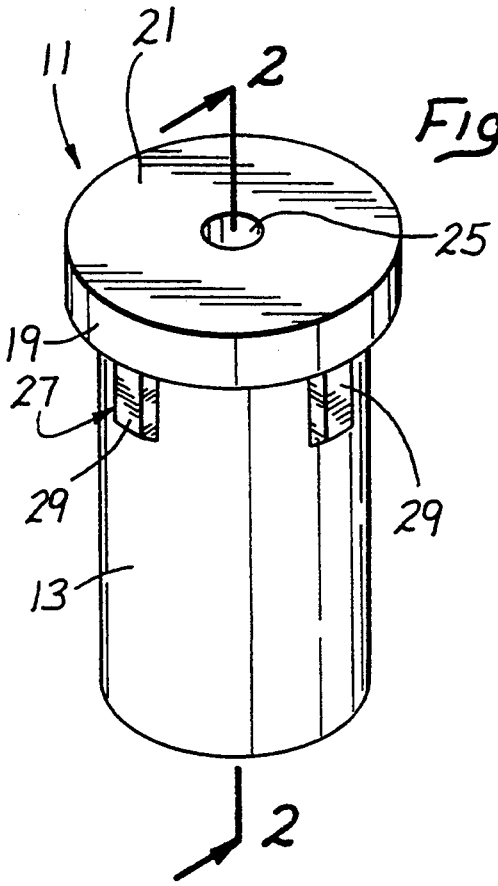
Fig. 1
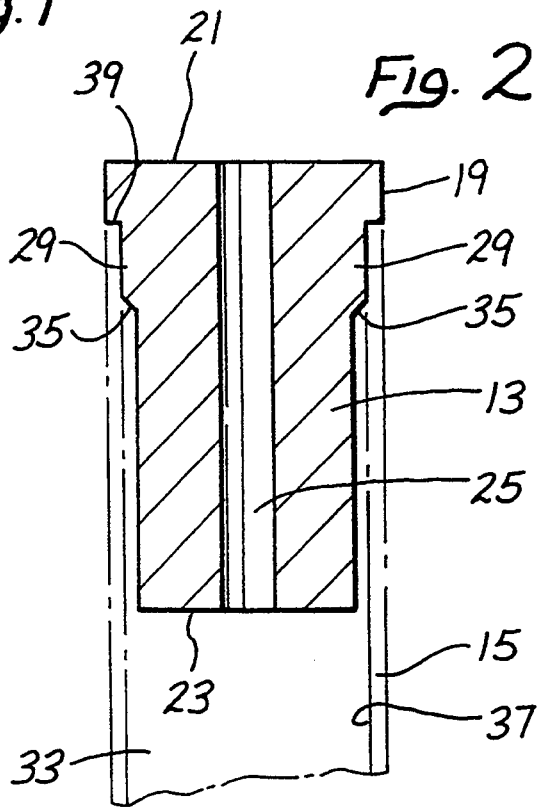
Fig. 2
Fig. 3
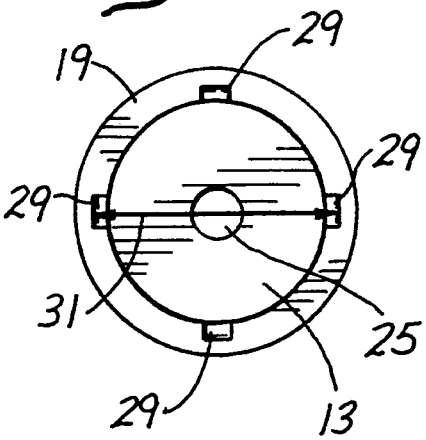
Fig. 4
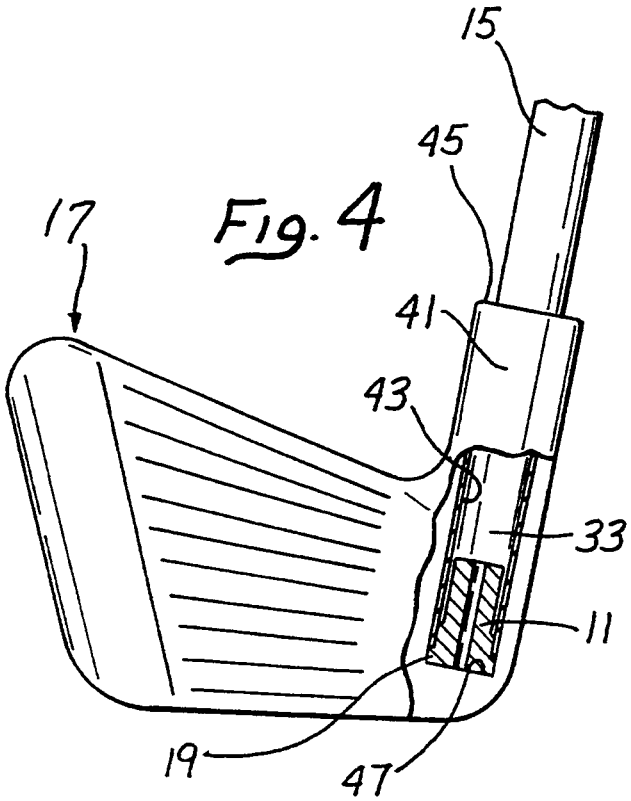

SWING WEIGHT WITH LOCKING FEATURE AND GOLF CLUB AND METHOD UTILIZING THE SAME

BACKGROUND OF THE INVENTION

In order to provide the desired characteristics to a set of golf clubs, it is common practice to appropriately weight each of the clubs using swing weights of predetermined magnitudes. A variety of techniques can be used to accomplish this including the techniques shown and described in my U.S. Pat. No. 4,220,336 and in my U.S. application Ser. No. 027,410 filed on Mar. 8, 1993.

A typical golf club includes a golf club head having a passage terminating in the head and elongated tubular shaft having a generally axially extending bore opening at one end of the shaft. An end portion of the shaft is received in the passage of the golf club head and is affixed to the golf club head. It is common practice to retain the swing weight in the end portion of the shaft which is received within the golf club head.

In the manufacture of golf clubs of this type, a swing weight of the desired weight is coated with an adhesive, such as an epoxy, and a main body of the swing weight is inserted into the bore of the shaft. The swing weight has a flange which is too large to enter the bore and which remains outside the bore adjacent one end of the shaft. An end portion oft he shaft is then coated with an epoxy and inserted into the hosel of a golf club head.

One problem with this technique is that when the shaft is removed or partly removed from the golf club head, the swing weight may come out of the shaft and become lodged in the hosel. This can make it difficult to remove the swing weight from the hosel and slows down production.

SUMMARY OF THE INVENTION

This invention overcomes the problems described above in connection with swing weights. With this invention, the swing weight can be force fit into the bore of the shaft. Consequently, the swing weight remains attached to the shaft even if the shaft is removed or partly removed from the hosel. Thus, the swing weight does not become lodged in the hosel and production time is saved.

Although the swing weight is force fit into the shaft, it can be easily removed if necessary as by gripping the flange with pliers or utilizing a ram rod through the other end of the shaft.

In a preferred form, the swing weight has a main body sized and adapted to be received in the bore of the tubular shaft of the golf club. The swing weight also has a flange adjacent one end of the main body, and the flange has a larger cross-sectional dimension than the main body.

A feature of this invention is that the swing weight has a locking region on the main body adjacent to flange. The locking region has a cross-sectional dimension which is less than a cross-sectional dimension of the flange and which is greater than a cross sectional dimension of other regions of the main body. Consequently, the locking region can be force fit into the bore of the shaft.

To facilitate obtaining of the force fit, the locking region preferably has an end portion remote from the flange which tapers radially outwardly as such end portion extends toward the flange. Force fitting of the swing weight into the bore of the shaft is also facilitated if the locking region is malleable and readily deformable.

In a preferred construction, the locking region includes at least one rib and in a more preferred construction, a plurality of ribs extending toward the flange. By utilizing circumferentially spaced ribs, more space is provided to receive the flow of material of the ribs during the force fitting operation and by arranging the ribs circumferentially in a predetermined manner they can substantially center the swing weight in the bore of the tubular shaft. When assembled, the locking region is deformed and substantially in contact with the shaft within the bore of the shaft.

According to the method of this invention, the swing weight is force fit into the generally axially extending bore of an elongated shaft with the swing weight being adjacent one end of the shaft. Although the force fit could alone be used to attach the swing weight to the shaft, preferably an adhesive, such as an epoxy, is also applied to the swing weight. The shaft is then affixed to a golf club head adjacent such end of the shaft.

Before the adhesive cures, it is sometimes necessary or desirable to remove or partly remove the shaft from the hosel. This may be done, for example, to assure that the adhesive is contacting all of the desired surfaces. With this technique, the force fit prevents removal of the swing weight from the shaft during assembly, and after the adhesive cures, it substantially augments the attachment of the swing weight to the shaft.

The invention, together with additional features and advantages thereof may best be understood by reference to the following description taken in connection with the accompanying illustrative drawing.

BRIEF DESCRIPTION OF THE DRAWING

FIG. 1 is a perspective view of a swing weight constructed in accordance with the teachings of this invention.

FIG. 2 is a sectional view taken generally along line 2—2 of FIG. 1 with a golf club shaft being shown in phantom lines.

FIG. 3 is a bottom plan view of the swing weight of FIG. 1.

FIG. 4 is a fragmentary elevational view partially in section of a golf club which includes the swing weight.

DESCRIPTION OF THE PREFERRED EMBODIMENT

FIG. 1 shows a swing weight 11 which includes a main body 13 of generally cylindrical configuration which is sized and adapted to be received in a tubular shaft 15 (FIGS. 2 and 4) of a golf club 17. The swing weight also includes a flange 19 at one end of the main body 13. The flange 19 has larger cross-sectional dimensions than the main body 13. In this embodiment, the flange 19 is in the form of a cylindrical disc, and its diameter is greater than the diameter of the main body 13. The swing weight 11 has opposite, planar end faces 21 and 23 and a cylindrical axial passage 25 extending completely through the swing weight between the end faces 21 and 23.

The swing weight 11 also includes a locking region 27 on the main body 13 adjacent the flange 19. Although the locking region 27 can take different forms, in the embodiment illustrated, it includes four ribs 29 extending axially along the end portion of the main body 13 contiguous the flange 19. The ribs 29 are equally spaced circumferentially, i.e. about 90° center to center in the embodiment illustrated. In this embodiment, the ribs are identical.

As best seen in FIG. 3, because of the ribs 29 the locking region has a cross-sectional dimension 31 which is less than a cross-sectional dimension, i.e., the diameter, of the flange 19 and which is greater than the diameter of the main body 13. The diameter of the main body 13 should be small enough to be easily received within an axially extending bore 33 (FIG. 2) of the shaft 15 and the dimension 31 should be large enough to form a suitable force fit with the bore 33. For example, each of the ribs 29 may have a radial dimension of between about 0.005 inch and about 0.010 inch.

Each of the ribs 29 has a tapered end portion or inclined end surface 35 remote from the flange 19 which tapers radially outwardly as such end portion extends toward the flange. This tapered end portion or surface forms a lead in to the bore 33 to facilitate force fitting of the swing weight 11 in the bore.

The force fitting is also facilitated without risk of damage to the shaft 15 by making the ribs 29 malleable and readily deformable. Preferably the entire swing weight 11 is of integral one piece construction and so the entire weight may be malleable and readily deformable. The swing weight 11 may be of any material which provides these characteristics and which provides the desired mass without requiring that the weight be unduly long. For example, the swing weight 11 may be constructed of, or include, a metal such as a lead alloy. For example, the swing weight 11 will usually have a weight of from about one gram to about 12 grams with weights in the range of about one to about two grams being typical.

According to the method of this invention, the swing weight 11 is force fit into the bore 33 of the shaft 15 as shown in FIG. 2. Because of the malleable, readily deformable nature of the ribs 25, this force fitting causes the shaft 15 to displace material of the ribs axially and/or circumferentially without damaging or significantly distorting the end portion of the shaft 15 into which the swing weight is inserted. The ribs 29 are thus in tight contact with a cylindrical inner wall 37 which defines the bore 33. This attaches the swing weight 11 to the shaft 15 with the main body 13 and the ribs 29 being received within the bore 33 and with the flange 19 being outside the bore and contacting or essentially contacting an end 39 of the shaft 15.

Preferably the swing weight 11 is coated with a suitable adhesive, such as an epoxy, prior to being force fit into the bore 33. With this construction, the force fit attachment is useful during assembly and the adhesive, after it cures, is useful to augment the attachment of the swing weight to the shaft 15.

Next, the shaft 25 with the attached swing weight 11 is affixed to the golf club head 19 adjacent the end 39 of the shaft. More specifically, the golf club head 17 includes an integral tubular section or hosel 41 extending upwardly. The hosel 41 has a passage 43 which opens at an upper end 45 of the hosel and which terminates in an end wall 47 in the golf club head 17. The golf club head 17 may be either a wood or an iron.

Next the end portion of the shaft 15 which contains the swing weight 11 is coated with a suitable adhesive, such as an epoxy, and inserted into the passage 43 until the flange 19 of the swing weight 11 bottoms out on the end wall 47 of the passage. The force fit between the swing weight 11 and the shaft 15 prevents the swing weight from coming out of the bore 33 before the adhesive has sufficient time to cure. For example, if it is necessary or desirable to remove or partly remove the shaft 15 from the passage 43, this can be done without danger of the weight 11 falling out of the bore 33 and becoming lodged in the passage 43 of the hosel 41. The process is complete when the adhesives have cured.

Although an exemplary embodiment of the invention has been shown and described, many changes, modifications and substitutions may be made by one having ordinary skill in the art without necessarily departing from the spirit and scope of this invention.

I claim:

1. In a swing weight for a golf club wherein the swing weight is adapted to impart a desired weight to the golf club and the swing weight has a main body sized and adapted to be received in a tubular shaft of the golf club, a flange adjacent one end of the main body and having a larger cross-sectional dimension than the main body and a longitudinal passage extending longitudinally through the swing weight, the improvement comprising:

a deformable locking region on the main body adjacent said flange, said main body having a cross-sectional dimension through said locking region which is less than a cross-sectional dimension of the flange and which is greater than a cross-sectional dimension through the remaining regions of the main body.

2. An improvement as defined in claim 1 wherein said locking region has an end portion remote from the flange which tapers radially outwardly as such end portion extends toward said flange.

3. An improvement as defined in claim 1 wherein said locking region is malleable.

4. An improvement as defined in claim 1 wherein said locking region includes at least one rib.

5. An improvement as defined in claim 4 wherein said rib has a radial dimension of between about 0.005 inch and about 0.010 inch.

6. An improvement as defined in claim 1 wherein said locking region includes a plurality of ribs extending toward said flange.

7. An improvement as defined in claim 6 wherein said ribs are arranged circumferentially to substantially center the swing weight on a tubular shaft of a golf club when the swing weight is in the tubular shaft.

8. An improvement as defined in claim 7 wherein at least one of the ribs has an end portion remote from the flange which tapers radially outwardly as such end portion extends toward said flange.

9. A method of making a golf club comprising:

force fitting a swing weight into a generally axially extending bore of an elongated golf club shaft to attach the swing weight to the shaft with the swing weight being adjacent one end of the shaft;

affixing the shaft to a golf club head adjacent said one end of the shaft;

the swing weight including a main body, a flange adjacent one end of the main body and a locking region adjacent said flange and the step of force fitting including inserting the main body into the bore and force fitting the locking region into the bore with the flange being outside the bore adjacent said one end of the shaft.

10. A method as defined in claim 9 including bonding the swing weight to the shaft.

11. A method as defined in claim 9 wherein the locking region is deformable and the step of force fitting causes the shaft to deform the locking region.

* * * * *